US008172095B1

(12) United States Patent
Herlihy

(10) Patent No.: US 8,172,095 B1
(45) Date of Patent: May 8, 2012

(54) MOUNTABLE TOOL STORAGE AND ORGANIZATION APPARATUS

(76) Inventor: Tim Herlihy, Charlotte, NC (US)

( * ) Notice: Subject to any disclaimer, the term of this patent is extended or adjusted under 35 U.S.C. 154(b) by 319 days.

(21) Appl. No.: 12/694,138

(22) Filed: Jan. 26, 2010

Related U.S. Application Data

(60) Provisional application No. 61/147,181, filed on Jan. 26, 2009.

(51) Int. Cl.
*A47H 1/00* (2006.01)

(52) U.S. Cl. ..... 211/70.6; 211/95

(58) Field of Classification Search ..... 211/86.01, 211/87.01, 70.6, 70, 78, 163, 95, 96, 115; 248/349.1, 521
See application file for complete search history.

(56) References Cited

U.S. PATENT DOCUMENTS

| | | | | |
|---|---|---|---|---|
| 2,868,386 | A * | 1/1959 | Seyforth | 211/95 |
| 3,379,484 | A | 4/1968 | Kling | |
| 3,391,796 | A | 7/1968 | Cross | |
| 3,514,883 | A | 6/1970 | Albright | |
| 3,780,875 | A * | 12/1973 | Scholl | 211/115 |
| D327,187 | S | 6/1992 | Swon | |
| 5,139,155 | A | 8/1992 | Laxson | |
| 5,462,178 | A * | 10/1995 | Wallach et al. | 211/95 |
| 5,494,177 | A * | 2/1996 | Todd, Jr. | 211/163 |
| 5,505,319 | A * | 4/1996 | Todd, Jr. | 211/95 |
| 5,971,169 | A * | 10/1999 | Orr et al. | 211/95 |
| 6,272,779 | B1 | 8/2001 | Seiher et al. | |
| 6,273,277 | B1 * | 8/2001 | Geldenhuys | 211/70 |
| D455,221 | S | 4/2002 | Smith | |
| 6,505,749 | B1 * | 1/2003 | Panetta et al. | 211/86.01 |
| 6,808,077 | B2 * | 10/2004 | McConnell | 211/70.6 |
| 2007/0158288 | A1 * | 7/2007 | Rotolo | 211/115 |

* cited by examiner

*Primary Examiner* — Jennifer E. Novosad

(57) ABSTRACT

A tool storage and organization apparatus featuring a rotating tool carousel comprising a base to which two interconnected storage panels are attached which store and organize tools and hardware; a central axle extending through the intersection of the storage panels, the first end extends downwardly through the base and the second end extends upwardly past the storage panels; two mounting brackets for mounting to a wall; a base arm pivotally attached to each mounting bracket at the bottom end, the base arms cooperate to engage the first end of the axle; and a top arm pivotally attached to each mounting bracket at the top end, the top arms cooperate to engage the second end of the axle; wherein the tool carousel is permitted to rotate freely in a first direction or second direction either with respect to the axle or along with the axle.

20 Claims, 19 Drawing Sheets

MOUNTABLE TOOL STORAGE AND ORGANIZATION APPARATUS

CROSS REFERENCE

This application claims priority to U.S. provisional application Ser. No. 61/147,181 filed Jan. 26, 2009, the specifications of which is incorporated herein by reference in its entirety.

FIELD OF THE INVENTION

The present invention is directed to devices for tool storage and/or organization, more particularly to a mountable storage and organization apparatus including a rotatable storage carousel supported by at least one bracket adapted to be mounted to a wall or other supporting structure.

BACKGROUND OF THE INVENTION

The wide variety of tools, hardware and other items typically found in a garage, shop or other work area are conventionally stored and organized in a collection of wall-mounted, free standing and workbench-seated apparatus. While wall-mounted storage apparatus, such as peg-board and wall cabinets, are beneficial in clearing floor space, they often consume large amounts of wall space, are not able to efficiently utilize corner space, and have fixed mounting features corresponding to their dimensions. Free standing and workbench-seated storage apparatus, such as toolboxes, floor cabinets and organizers with castors, consume not only wall space when positioned against a wall, but floor space as well. The need for multiple, spaced-apart storage apparatus to store a variety of tools and hardware not only leads to a crowded and cluttered work space, but also increases the time it takes to locate a specific tool when needed.

The present invention features a mountable tool storage and organization apparatus for centrally locating a wide variety of tools and hardware in an efficient and space-optimizing manner. The apparatus of the present invention is adapted to be mounted in a position elevated from the floor, and includes adjustable mounting brackets for exploiting any desired mounting location, such as a corner.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a tool storage and organization apparatus comprising a rotating tool carousel comprising a base to which a first storage panel and a second storage panel are attached, the storage panels function to store and organize tools and hardware; a rotating system extending downwardly through the base and upwardly pas top edges of the storage panels, wherein the tool carousel is permitted to rotate freely in a first direction or second direction either (i) with respect to the rotating system or (ii) along with the rotating system; one or more (e.g., two) mounting brackets adapted to be mounted to a supporting structure such as a wall; a first base arm pivotally attached to the first mounting bracket near the first end extending laterally from the first mounting bracket, wherein a second end of the first base arm engages the rotating system; a first top arm pivotally attached to the first mounting bracket near the second end, the top arm extends laterally from the mounting bracket, wherein a second end of the first top arm engages the rotating system; and a spacer component positioned between an upper surface of the base arm and the base of the tool carousel to space the base of the tool carousel from the base arm and to permit the tool carousel to be rotated.

In some embodiments, a second base arm is pivotally attached to the second mounting bracket near the first end extending laterally from the second mounting bracket. The second end of the second base arm can cooperate with the first base arm to engage the rotating system (e.g., first end of an axle). In some embodiments, a second top arm is pivotally attached to the second mounting bracket near the second end. The second top arm extends laterally from the mounting bracket. The second end of the second top arm can cooperate with the first top arm to engage the rotating system (e.g., second end of the axle).

In some embodiments, the storage panels are constructed as a single piece. In some embodiments, the storage panels are constructed from a material comprising a pegboard, slat board, or a grid that defines a plurality of openings. In some embodiments, the storage panels interconnect to form a structure having a generally plus sign-shaped cross section. In some embodiments, the tool carousel further comprises one or more storage cabinets (e.g., with drawers).

In some embodiments, the rotating system comprises a central axle extending through an intersection of the first storage panel and the second storage panel, the axle has a first end that extends downwardly through the base and a second end that extends upwardly past top edges of the storage panels. In some embodiments, a shaft is provided through the first storage panel and the second storage panel to allow the axle to be received.

In some embodiments, the rotating system comprises a ball bearing system, wherein the second end of the first top arm and the second end of the second top arm cooperate to engage the ball bearing system, wherein the second end of the first base arm and the second end of the second base arm cooperate to engage pivot pin that extends through the base to the storage panel, wherein the tool carousel is permitted to rotate freely in a first direction or second direction either (i) with respect to the ball bearing system and pivot pin or (ii) along with the ball bearing system and pivot pin. In some embodiments, the ball bearing system comprises a bowl component disposed on a top edge of the storage panel, and a ball that engages the second end of the first top arm and the second end of the second top arm, the ball snugly and rotatably fits into the bowl component.

In some embodiments, the mounting brackets each comprise a plurality of holes for receiving screws, bolts or nails. In some embodiments, the first top arm is pivotally attached to the first mounting bracket or the second top arm is pivotally attached to the second mounting bracket via a first hinge (e.g., a three-loop butt-type hinge). In some embodiments, the first base arm is pivotally attached to the first mounting bracket or the second base arm is pivotally attached to the second mounting bracket via a third hinge (e.g., a three-loop butt-type hinge).

In some embodiments, a shaft is provided through the intersection of the first storage panel and the second storage panel to allow the axle to be received. In some embodiments, the axle is a metal (e.g., titanium, aluminum, steel) rod. In some embodiments, the apparatus is constructed from a material comprising plastic, polyethylene, polyvinyl chloride (PVC), nylon, metal (e.g., titanium, aluminum, steel), metal alloy, or a combination thereof. In some embodiments, the apparatus further comprises a level to facilitate level mounting.

DESCRIPTION OF PREFERRED EMBODIMENTS

Referring now to FIG. 1-19, the present invention features a mountable tool storage and organization apparatus 20 functioning to store, organize, maintain and provide ready access to a wide variety of tools, hardware and other items safely and securely in a single location, for example elevated from the floor. The apparatus 20 may be scaled to hold any number and types of tools and hardware, any may be constructed from any type and combinations of material. For example, in some embodiments, components (e.g., molded pieces) of the apparatus 20 may be constructed from a material comprising plastics (e.g., rugged plastics) including but not limited to polyethylene, polyvinyl chloride (PVC), nylon, metal, wood, the like, or a combination thereof. In some embodiments, the apparatus 20 of the present invention is constructed from a material comprising plastic, metal (e.g., titanium, aluminum, steel), pegboard, slat board, wood, the like, or a combination thereof. For example, components such as brackets, fasteners, hinges, and pivot-related components may be constructed from a material comprising a metal (e.g., titanium, aluminum, steel, etc.) and/or metal alloy, which can provide strength and resistance to wear. The present invention is not limited to the aforementioned materials. Throughout the description, the apparatus 20 is shown mounted in various locations and to specific supporting structures, however, it is envisioned that the apparatus 20 may be mounted to any single structure or combination of structures capable of supporting the loaded weight of the apparatus 20. For example, the apparatus 20 may be mounted to wall studs of a single wall, multiple walls, between cabinets, to poles, to other structures or to combinations of structures.

Figure 1:
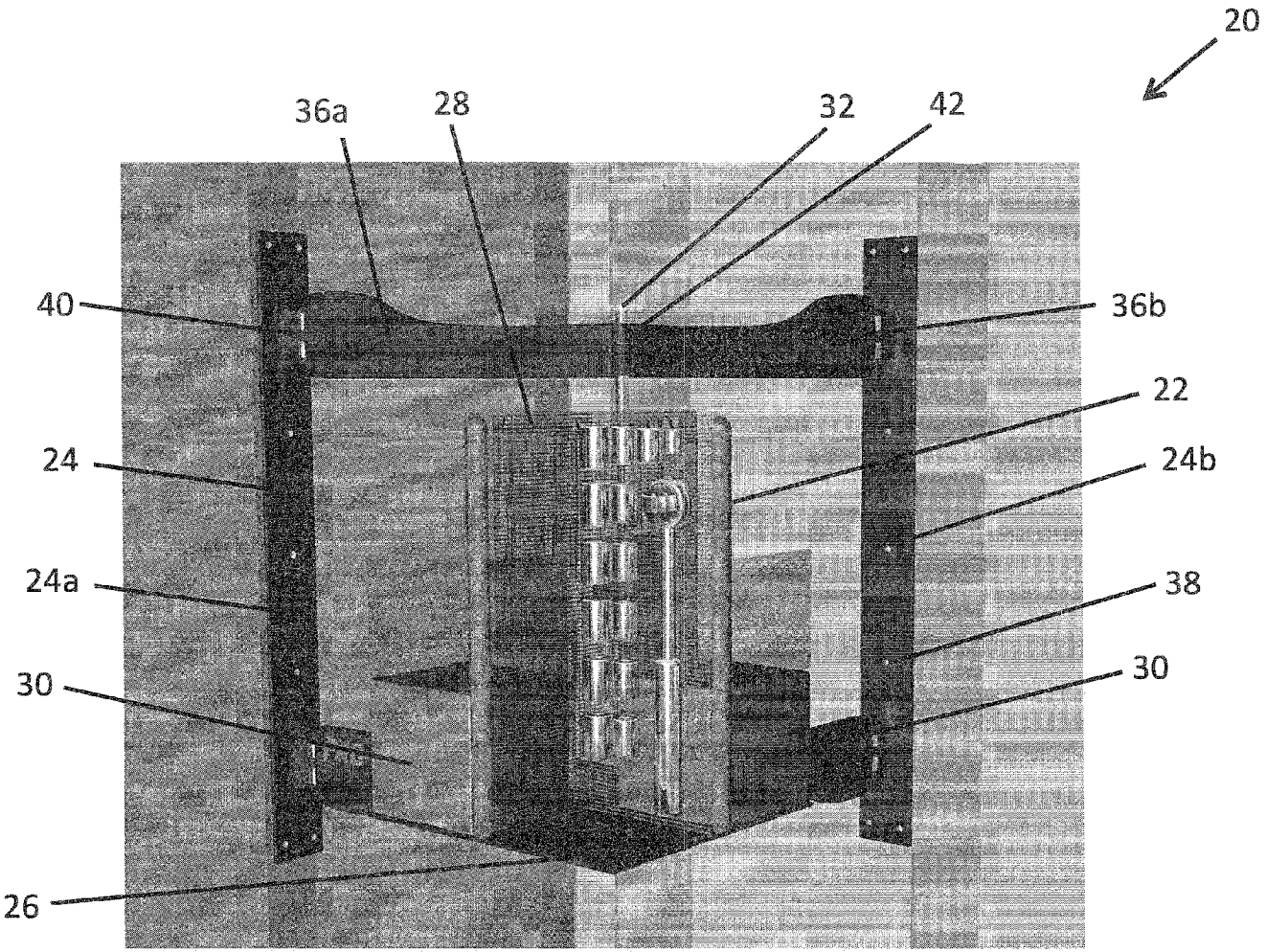
FIG. 1 is a perspective view of a storage and organization apparatus of the present invention comprising a rotating tool carousel supported by brackets.

Referring now to FIG. 1, the apparatus 20 of the present invention comprises a rotating tool carousel 22 for storing and organizing tools and hardware and a mounting system for mounting the tool carousel 22. The tool carousel 22 comprises a base 26 for supporting one or a plurality of interconnected, double-walled storage panels 28 for hanging and storing tools or one or a plurality of storage cabinets 30 (with optional drawers). The base 26 may resemble but is not limited to a generally flat panel (as shown in FIG. 1). The storage panels 28 as shown may be constructed from a material comprising a pegboard or a slat board (or a grid or a mesh) defining a plurality of openings (e.g., apertures) for receiving conventional hooks, hangers and other accessories. The openings can also accommodate existing wall mounted types of tool storage embodiments. As an example, pegboard has a plurality of (e.g., twenty for example) different hangers, hooks, clips, and the like that fit the pegboard to provide tool, hardware, and parts storage. The openings (e.g., apertures) may be aligned or offset from one another. The tool carousel 22 presents an open display of the storage surfaces and thereby an open viewing of stored tools.

The mounting system of the apparatus 20 of the present invention for mounting the tool carousel 22 comprises at least one at least one adjustable mounting bracket 24. FIG. 1 shows a first mounting bracket 24*a* and a second mounting bracket 24*b*, which are both adapted to be mounted to a wall or other supporting structure.

The tool carousel 22 may be customized based upon the application. For example, as a garage tool storage apparatus, the tool carousel 22 may be optimized to store a greater number of tools than hardware, thus requiring greater storage panel surface area than cabinets. As a craft storage apparatus, the tool carouser 22 may be optimized with a greater number of cabinets and drawers to store hardware and other items. In the embodiment shown in FIG. 1, one or more storage cabinets 30 are positioned and maintained between adjacent storage panels 28, which may optionally include drawers.

Figure 2:
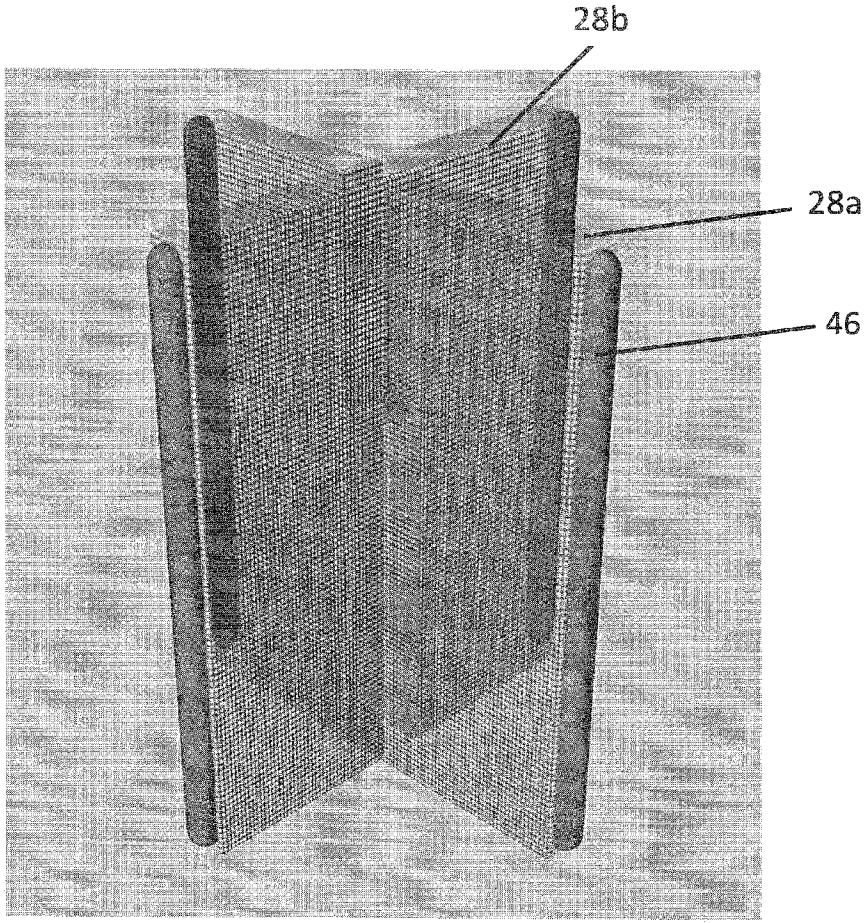
FIG. 2 is a perspective view of two storage panels of the tool carousel of the present invention.

In some embodiments, the apparatus 20 comprises a first storage panel 28*a* and a second storage panel 28*b*, which interconnect to form a structure having a generally plus sign-shaped cross section (see FIG. 2). The tool carousel 22 rotates via a rotating system. In some embodiments, the rotating system comprises a central axle 32, such as a metal (e.g., aluminum, titanium, steel) rod, that extends through the intersection of the storage panels 28 (the first storage panel 28*a* and the second storage panel 28*b*) to help maintain the panels 28*a*, 28*b* together. The axle 32 may also be the component about which the tool carousel 22 rotates. The axle 32 may or may not rotate itself. The axle 32 has a first end and a second end. The first end may be rotatably attached to the base 26 of the tool carousel 22, or the first end may extend through the base 26 (see FIG. 12). The second end may extend upwardly past the top edges, of the storage panels 28*a*, 28*b*. When installed, the tool carousel 22 is permitted to rotate freely in a first direction (e.g., clockwise) and/or a second direction (e.g., counterclockwise) with respect to the axle 32 or with respect to the mounting brackets 24. The user can apply force to the tool carousel 22 to rotate the carousel 22, such as by hand. In some embodiments, rotation of the carousel 22 is automated through a conventional means. Although not shown, a bearing may be included about each end of the axle 32 for facilitating smooth and easy rotation.

The mounting brackets 24*a*, 24*b* as shown in FIG. 1 are elongated panels having a first end and a second end. When assembled, the base 26 of the carousel 22 is positioned near the first ends of the mounting brackets 24. The top edges of the storage panels 28*a*, 28*b* are positioned near the second ends of the mounting brackets 24. Disposed near the second end of the first mounting bracket 24*a* is a first arm 36*a*. The first arm 36*a* extends outwardly from the first mounting bracket 24*a*, for example perpendicularly or laterally to the first mounting bracket 24*a*. Disposed near the second end of the second mounting bracket 24*b* is a second arm 36*b*. The second arm 36*b* extends outwardly from the second mounting bracket 24*b*, for example perpendicularly or laterally to the second mounting bracket 24*b*.

The first ends of the arms 36*a*, 36*b* may be pivotally attached to the respective mounting brackets 24*a*, 24*b* via a pivot mechanism (e.g., a first hinge 40). The first hinge 40 may include a three-loop butt-type hinge that permits an angle of rotation of the arm of about 180 degrees with respect to the mounting bracket 24. Adjustability in the angle between the arm 36 and its respective mounting bracket 24 permits the mounting bracket 24 to be moved to align with an underlying stud. The pivot mechanism (e.g., first hinge 40) also allows the arms 36 to be pivoted or folded if for example, the carousel 22 is not mounted (e.g., for storage purposes).

The second ends of the arms 36*a*, 36*b* engage the axle 32. In some embodiments, a second hinge 42 is disposed on the second ends of the arms 36, wherein the hinge pin of the second hinge 42 is the axle 32. With the use of the first mounting bracket 24*a* and second mounting bracket 24*b*, the tool carousel 22 can be supported in a stationary, but rotatable, position regardless of the distance between the mounting brackets 24*a*, 24*b*. A single mounting bracket 24 may be utilized in applications in which it is desired to both allow rotation of the tool carousel 22 as well as move the carousel with respect to the mounting bracket 24. Thus, it is envisioned that in some embodiments, the apparatus 20 may be stored within a corner or against a wall between uses.

As shown in FIG. 1, the mounting brackets 24*a*, 24*b* are positioned generally vertically in order to correspond to generally vertical underlying wall studs. In some embodiments, the mounting brackets 24*a*, 24*b* each comprise a plurality of holes 38 (e.g., apertures) for receiving conventional fasteners such as screws, bolts or nails, including pegboard tool hanging and storage fixtures. As shown in FIG. 1, the mounting brackets 24*a*, 24*b* each comprise a plurality of holes 38 spaced apart along the length of the brackets 24*a*, 24*b* (e.g., as measured from the first end to the second end). Although not shown, a level may be provided about any component of the apparatus to facilitate level mounting. Levels are well known to one of ordinary skill in the art.

Figure 3:
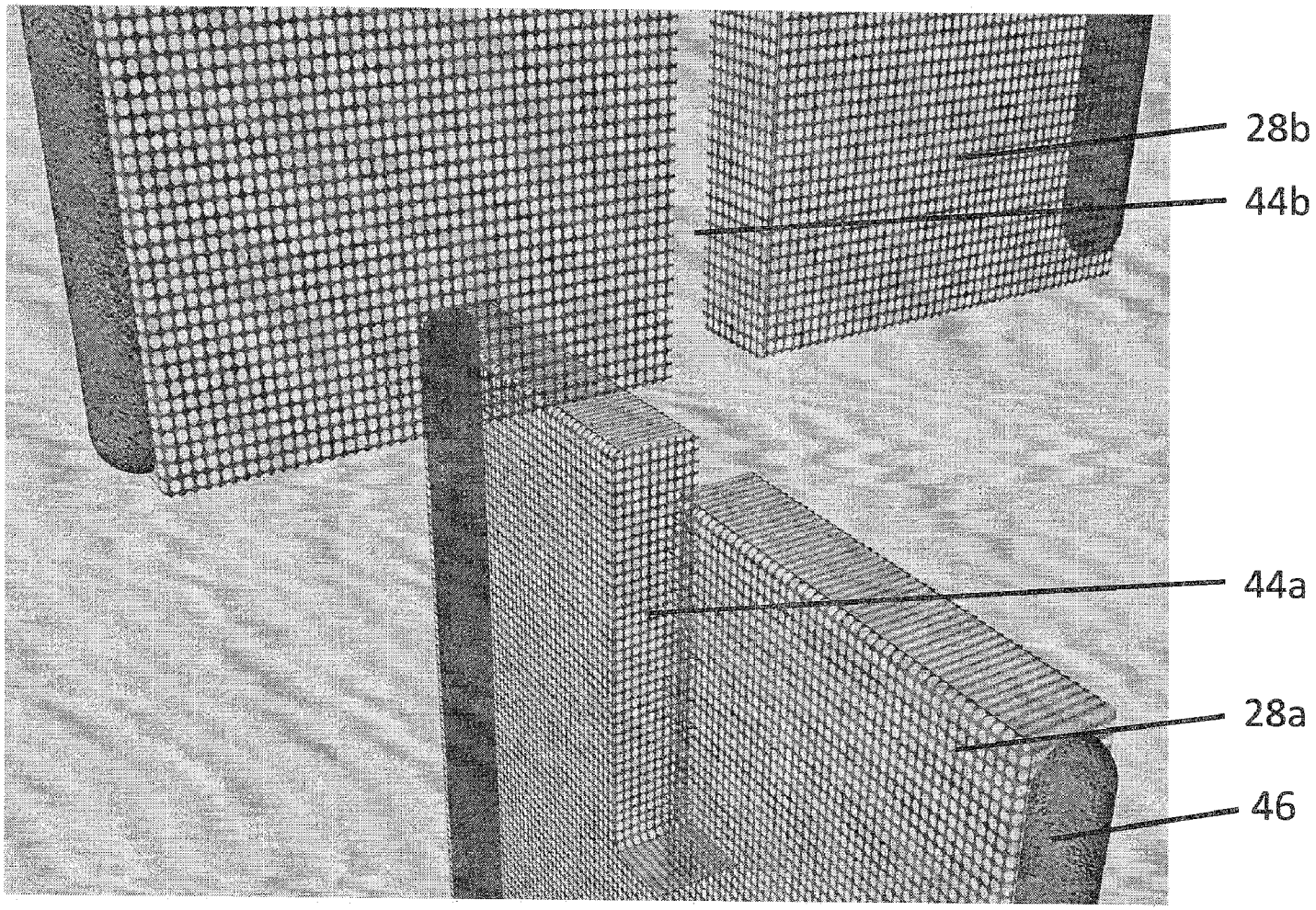
FIG. 3 is an exploded view of the interconnection of the storage panels of FIG. 2.

Referring now to FIG. 2 and FIG. 3, in some embodiments, the apparatus 20 comprises a first storage panel 28*a* and a second storage panel 28*b*, which interconnect to form a structure having a generally plus sign-shaped cross section. In some embodiments, the first storage panel 28*a* comprises a first slot 44*a* disposed in either the top edge or the bottom edge. The first slot 44*a* is for receiving a second slot 44*b* in the second storage panel 28*b*, the second slot 44*b* being in either the top edge or the bottom edge of the second storage panel 28*b*.

To assemble the tool carousel 22, the panels 28*a*, 28*b* can be arranged perpendicularly with respect to one another with their slots 44*a*, 44*b* aligned, and the panels 28*a*, 28*b* are slid together. In some embodiments, a shaft 33 is provided through the intersection of the panels 28*a*, 28*b* to allow the axle 32 to be received (see FIG. 14). The panels 28*a*, 28*b* may optionally include end covers 46.

Figure 4:
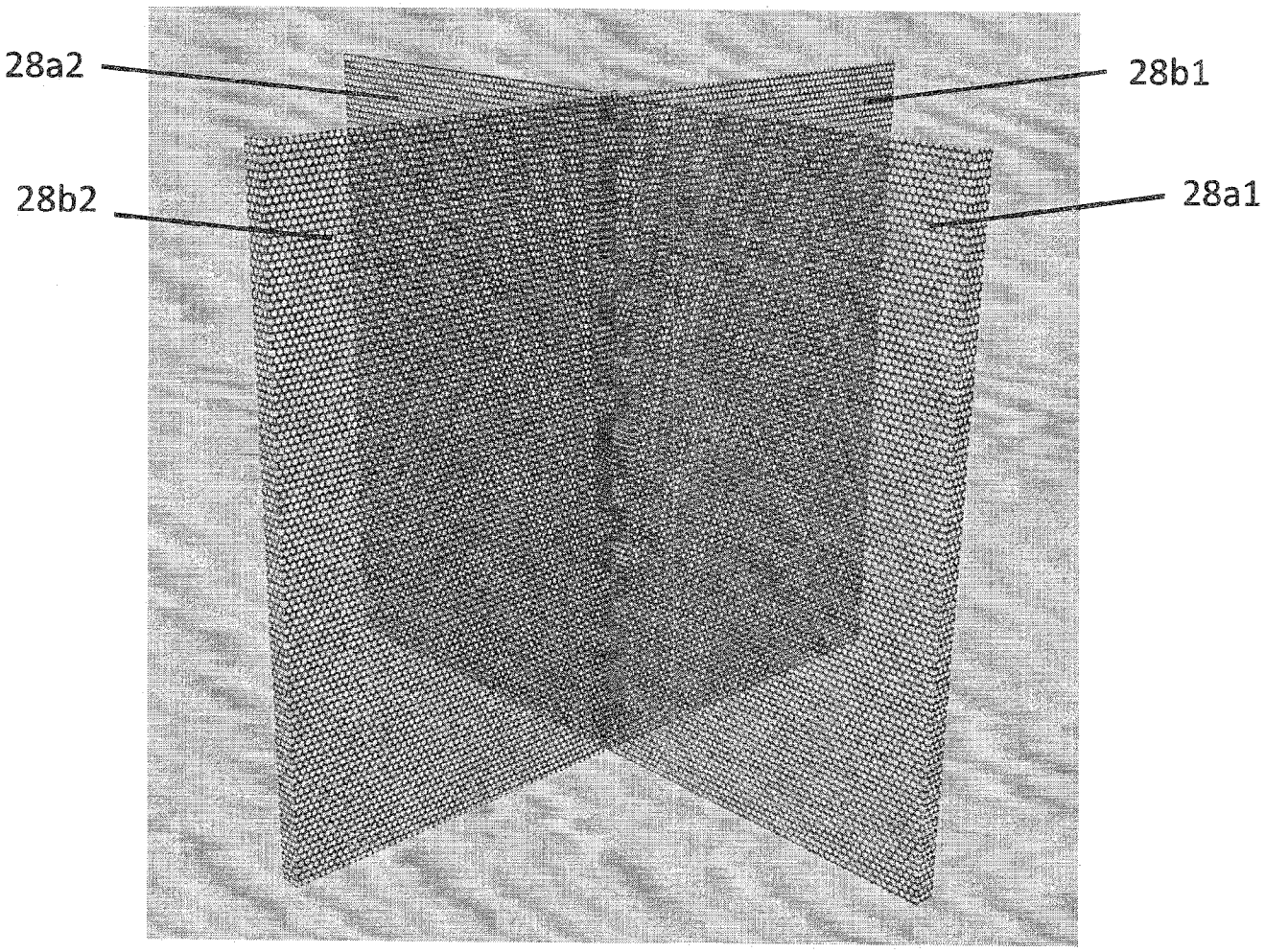
FIG. 4 is a perspective view of an alternative embodiment of storage panels.
Figure 5:
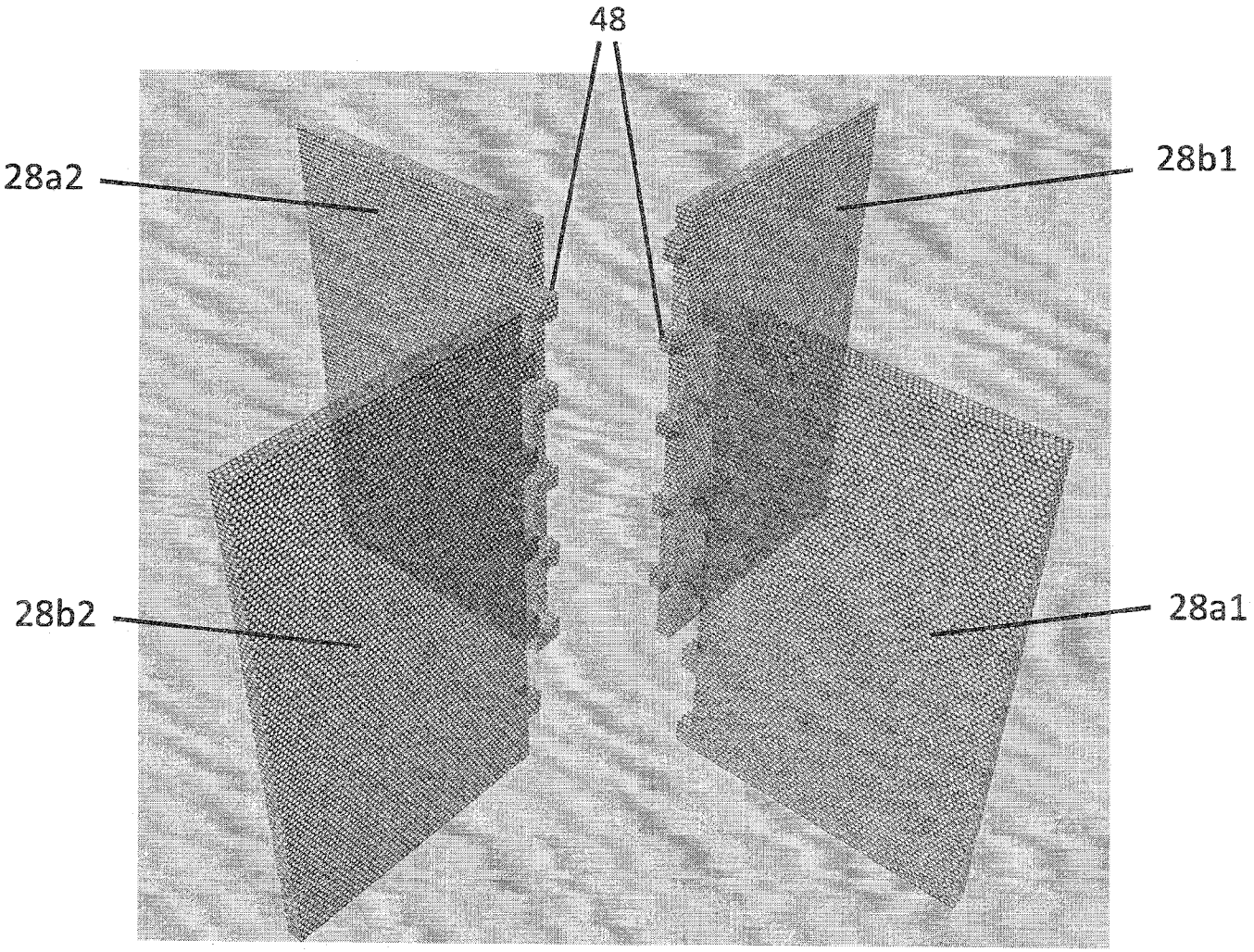
FIG. 5 is an exploded view of the storage panels of FIG. 4.
Figure 6:
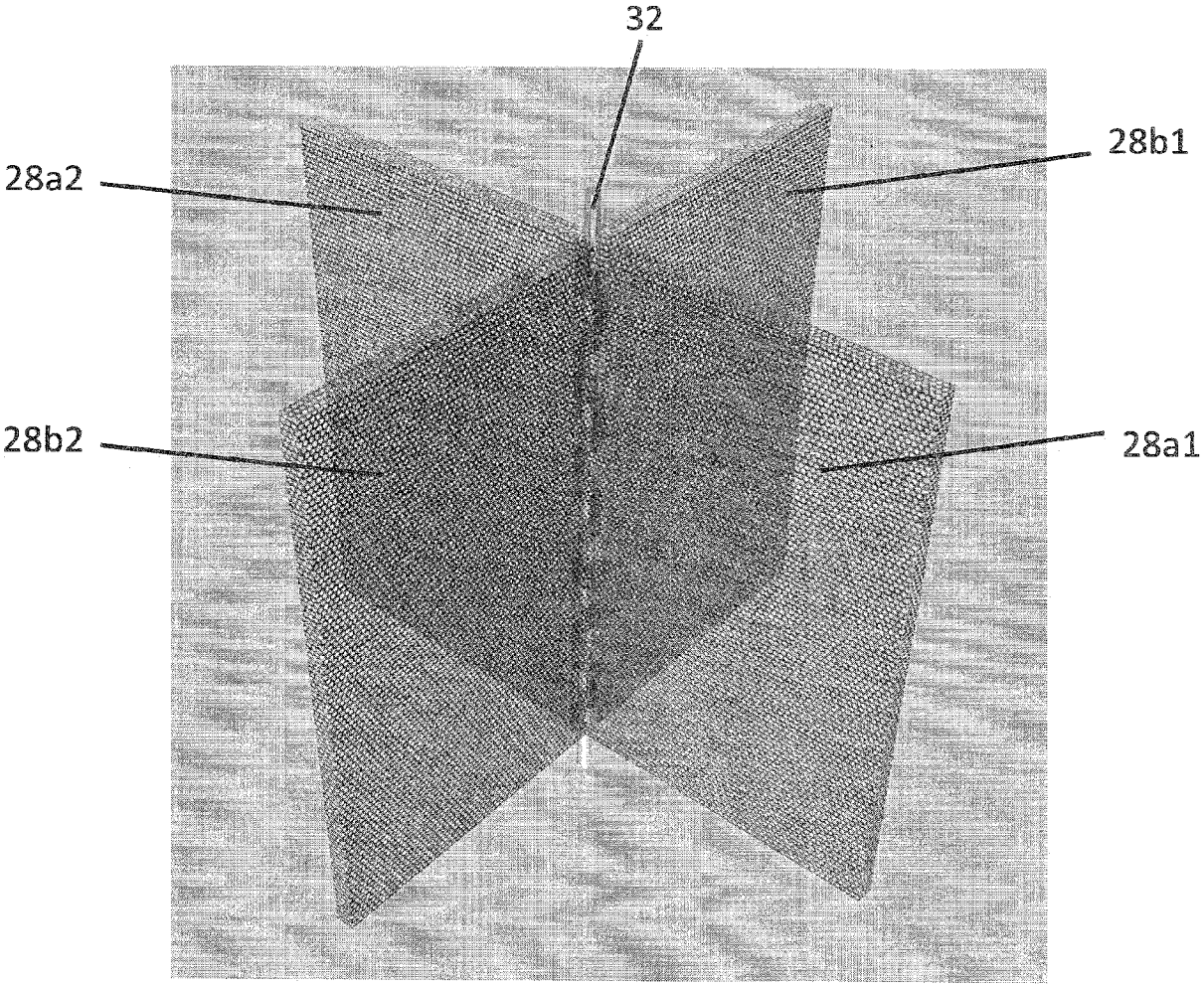
FIG. 6 is a perspective view of the storage panels of FIG. 4 further including an axle for maintaining the storage panels together and about which the tool carousel rotates.

Referring now to FIG. 4, FIG. 5, and FIG. 6, in an alternative embodiment, the apparatus 20 comprises a first storage panel 28*a* constructed from a first half panel 28*a*1 and a second half panel 28*a*2, and a second storage panel 28*b* constructed from a third half panel 28*b*1 and a fourth half panel 28*b*2. The four half panels may be maintained together by way of the axle 32, for example the axle 32 is received through the intersection of the inner edges of panels 28. A plurality of projections 48 is disposed on the inner edge of each panel 28, wherein the projections 48 can interlock (e.g., when all lie in the same vertical axis) and the axle 32 can be received (see FIG. 6). Although square projections 48 are shown in FIG. 5 (e.g., to prevent pivoting of the panels when assembled), loop-type projections such as those forming a butt hinge may be substituted to allow pivoting between panels 28 when assembled.

Figure 7:
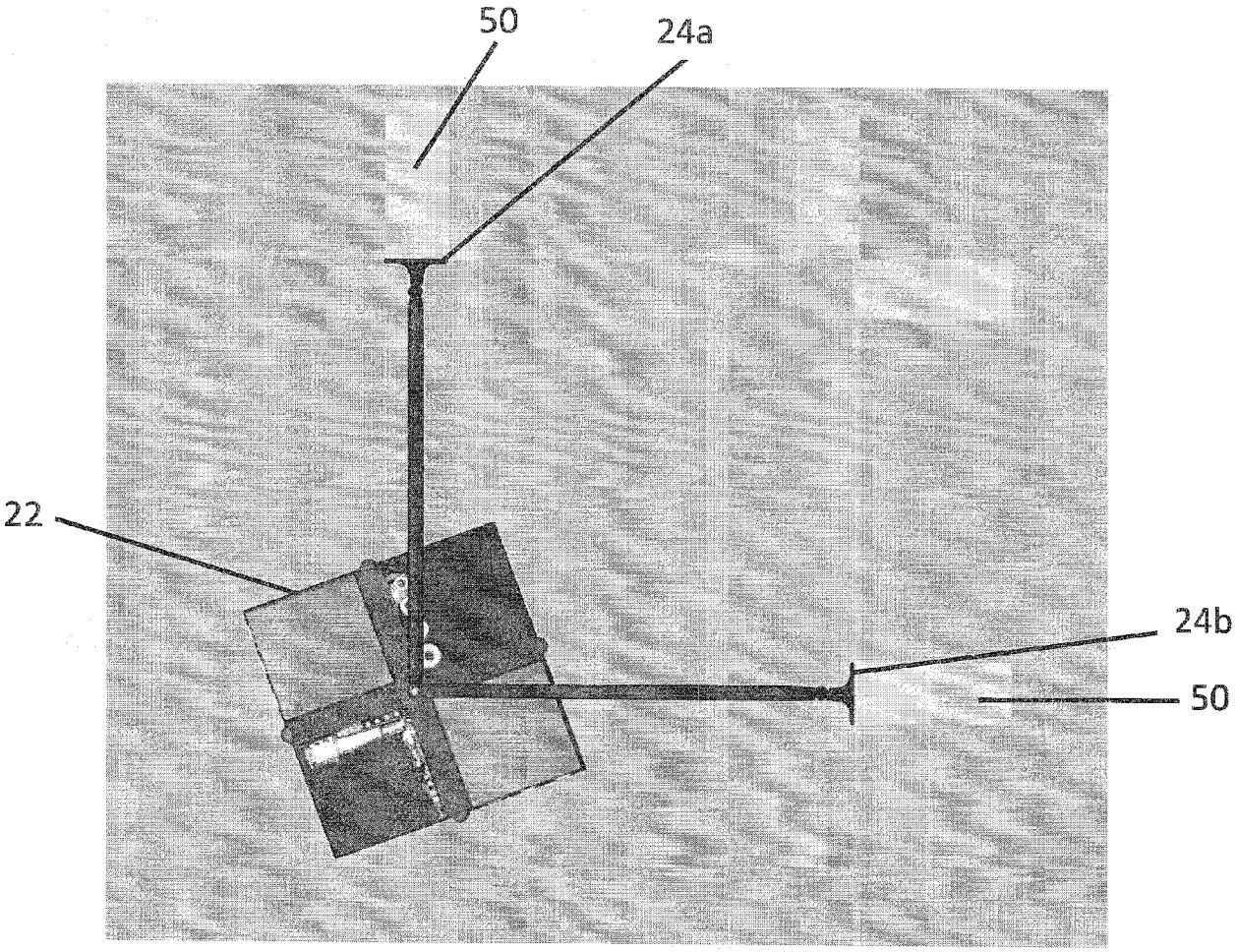
FIG. 7 is a top elevation view of the apparatus shown mounted in a corner.

Referring now to FIG. 7, the apparatus 20 is shown mounted within a corner to optimize the use of corner space. The first mounting bracket 24*a* is mounted on the first wall and the second mounting bracket 24*b* is mounted on the second wall. The brackets 24 are secured to wall studs 50 of adjacent walls. The ability of the arms 36 to pivot with respect to the mounting brackets 24 to pivot with respect to one another allows the mounting brackets 24 to be positioned to find a secure mounting structure, such as wall studs. Thus, the mounting location of the apparatus 20 is not limited by fixed dimensions of the apparatus 20, as is the case with many conventional storage apparatuses. The angle between the arms 36 may range anywhere from about 0 degrees to about 180 degrees.

Figure 8:
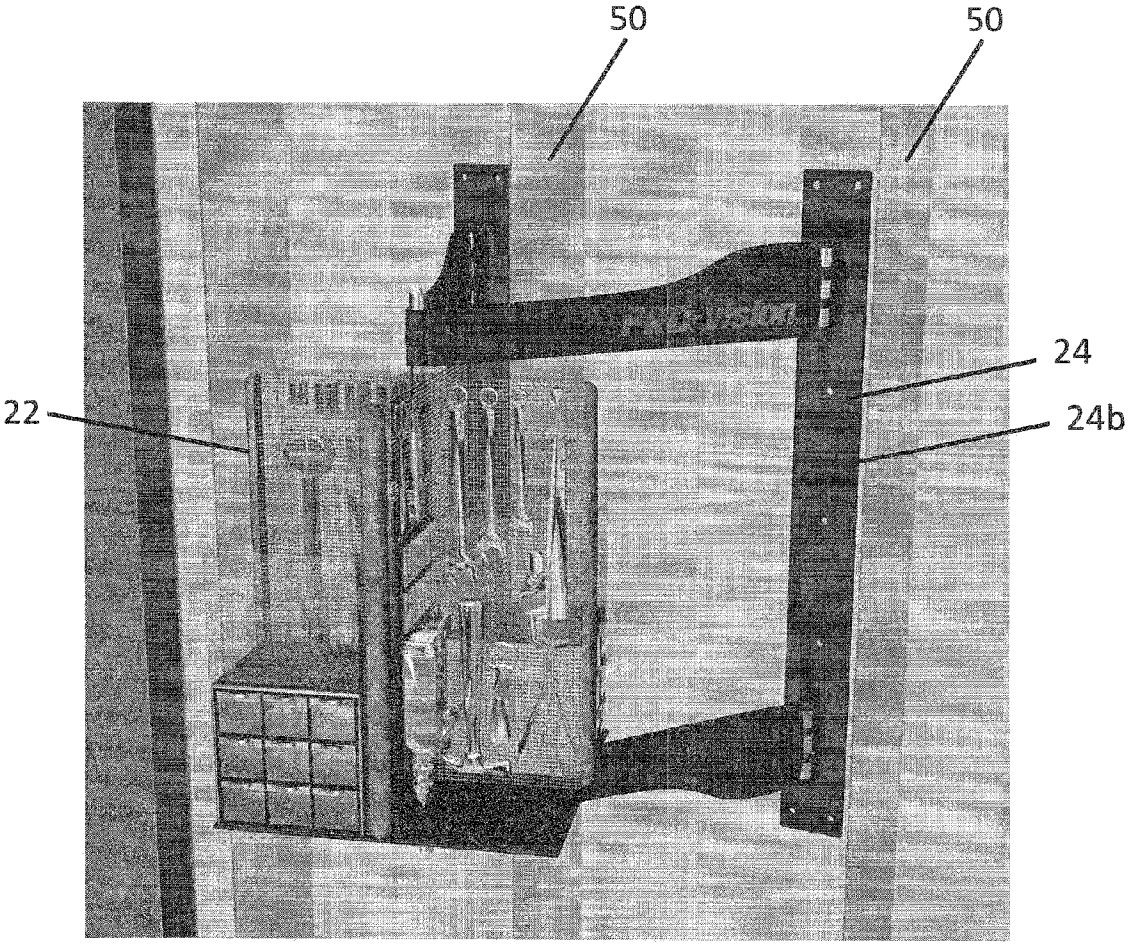
FIG. 8 is a perspective view of the apparatus shown mounted to a wall.
Figure 9:
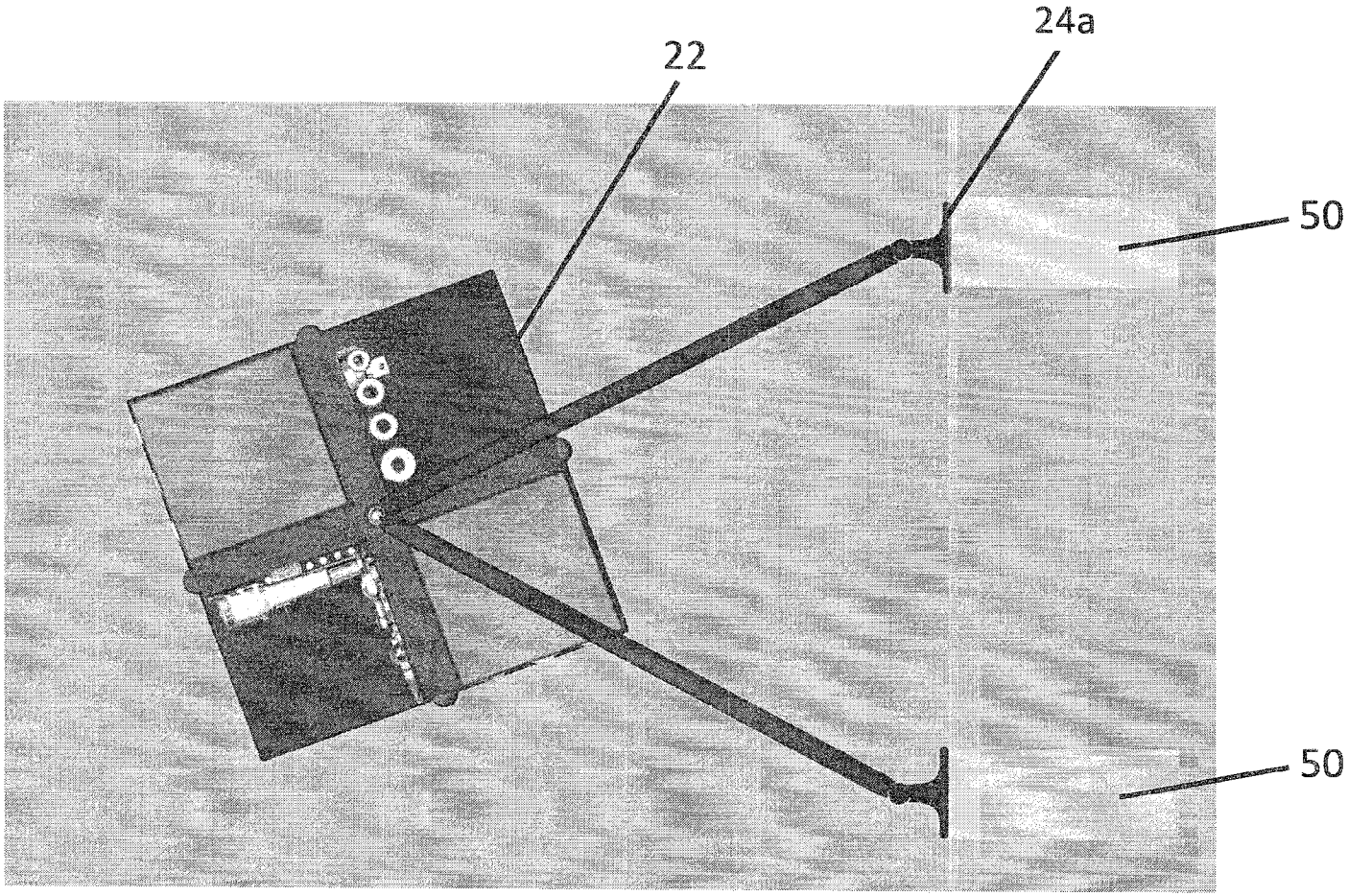
FIG. 9 is a top elevation view of the apparatus shown mounted to a wall.

Referring now to FIG. 8 and FIG. 9, the mounting brackets 24*a*, 24*b* are shown secured to underlying wall studs 50 of a single wall, and the angle between the arms 36 is less than about 90 degrees. As stated above, the angle between the arms 36 may range anywhere from about 0 degrees to about 180 degrees. Building codes commonly require studs to be positioned 16 inches apart, and thus the apparatus 20 may be secured to adjacent studs or may bridge a predetermined number of studs.

Figure 10:
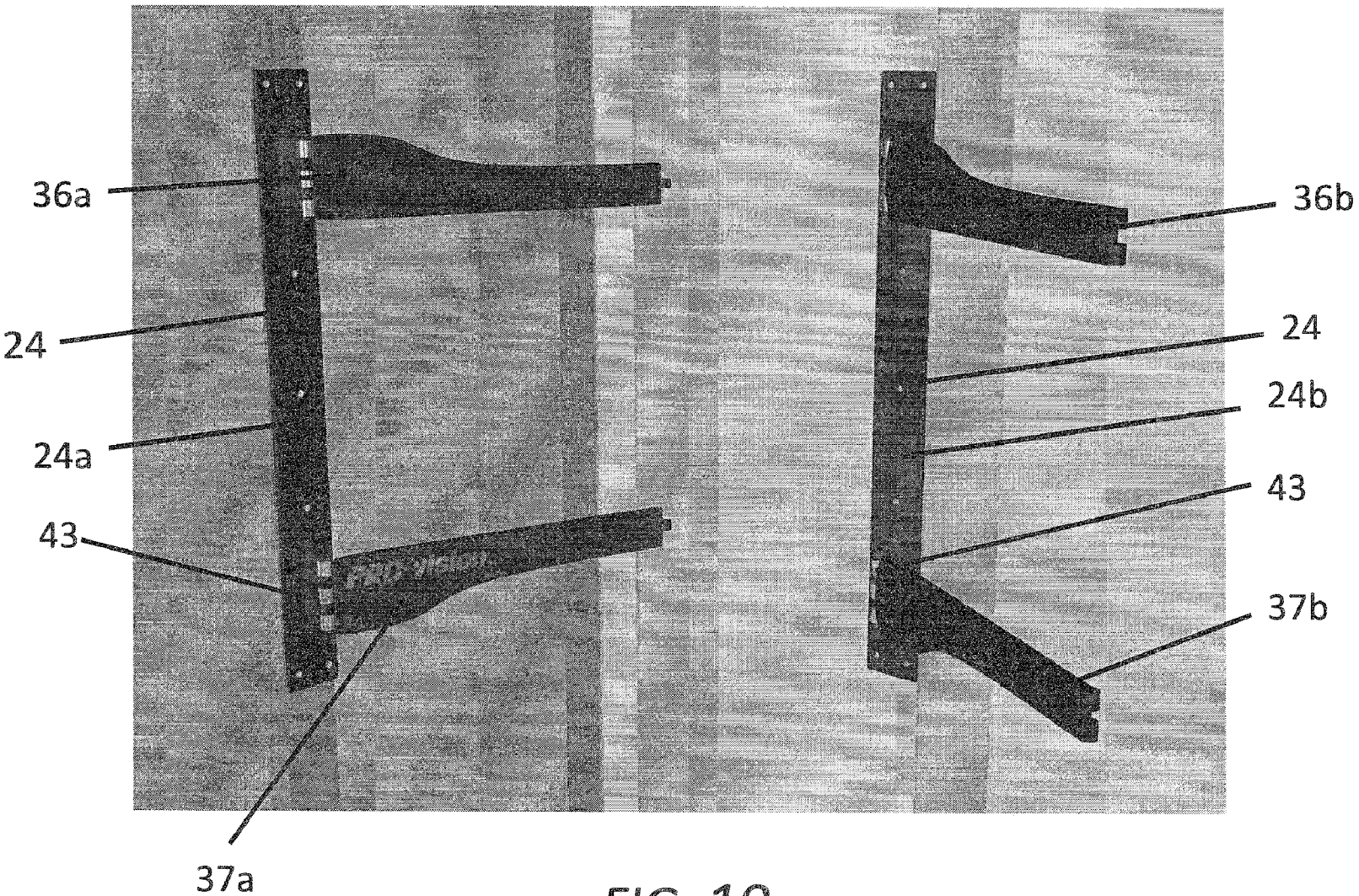
FIG. 10 illustrates the mounting brackets, wherein the tool carousel is removed.

Referring now to FIG. 10, in some embodiments, the arms 36 are tapered along the length, for example to help prevent or reduce flexing and twisting. In some embodiments, a first base arm 37*a* is disposed near the first end (e.g., bottom end) of the first mounting bracket 24*a*. The first base arm 37*a* extends outwardly from the first mounting bracket 24*a*, for example perpendicularly or laterally to the first mounting bracket 24*a*. In some embodiments, a second base arm 37*b* is disposed near the first end (e.g., bottom end) of the second mounting bracket 24*b*. The second base arm 37*b* extends outwardly from the second mounting bracket 24*b* for example perpendicularly or laterally to the second mounting bracket 24*b*.

The first ends, of the base arms 37*a*, 37*b* may be pivotally attached to the respective mounting brackets 24*a*, 24*b* via a pivot mechanism (e.g., a third hinge 43). The third hinge 43 may include a three-loop butt-type hinge that permits an angle of rotation of the arm of about 180 degrees with respect to the mounting bracket 24. Adjustability in the angle between the arm 37 and its respective mounting bracket 24 permits the mounting bracket 24 to be moved to align with an underlying stud. The pivot mechanism (e.g., third hinge 43) also allows the arms 37 to be pivoted or folded if, for example, the carousel 22 is not mounted (e.g., for storage purposes).

Figure 12:
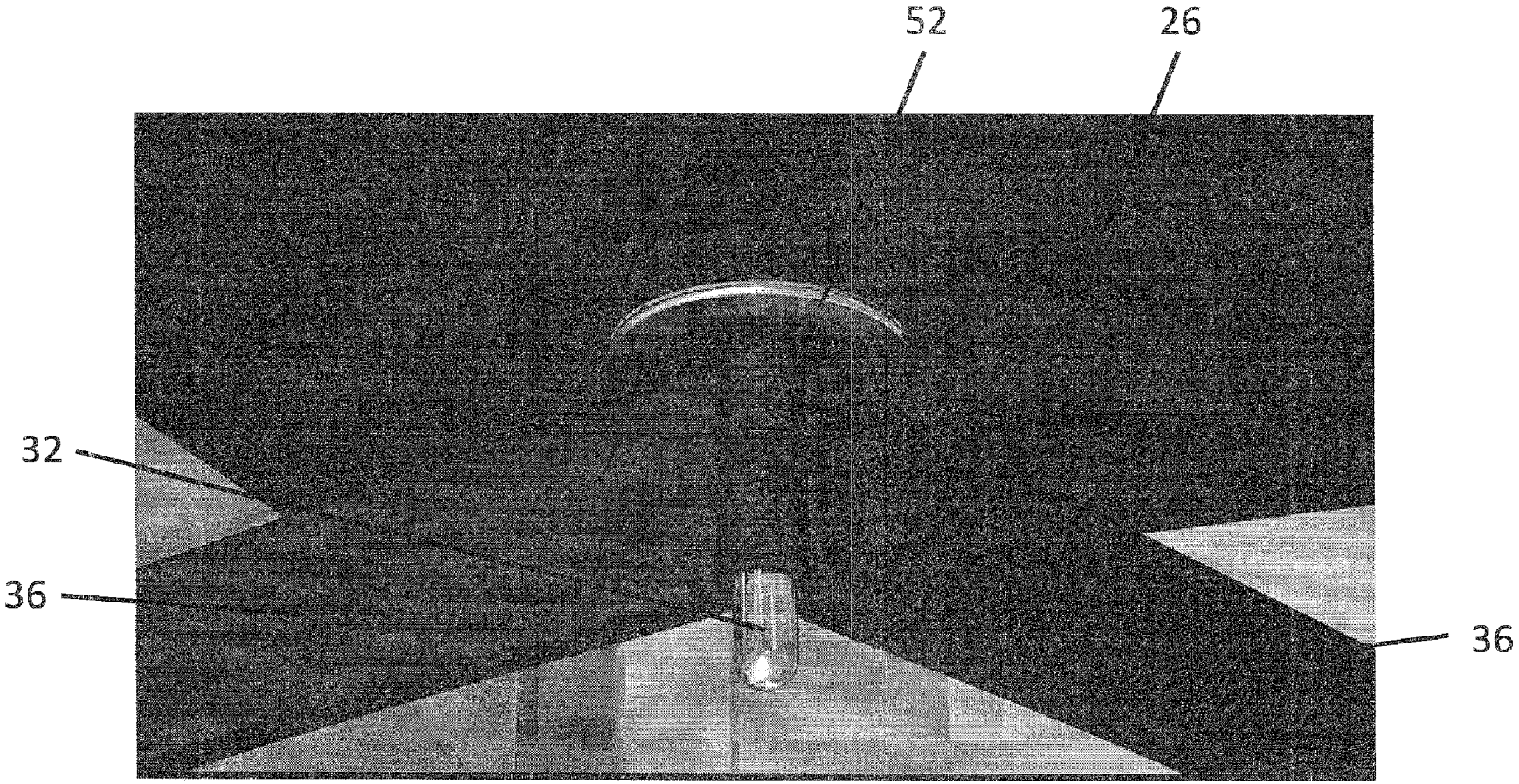
FIG. 12 is a detailed view of the base arms of the apparatus.
Figure 13:
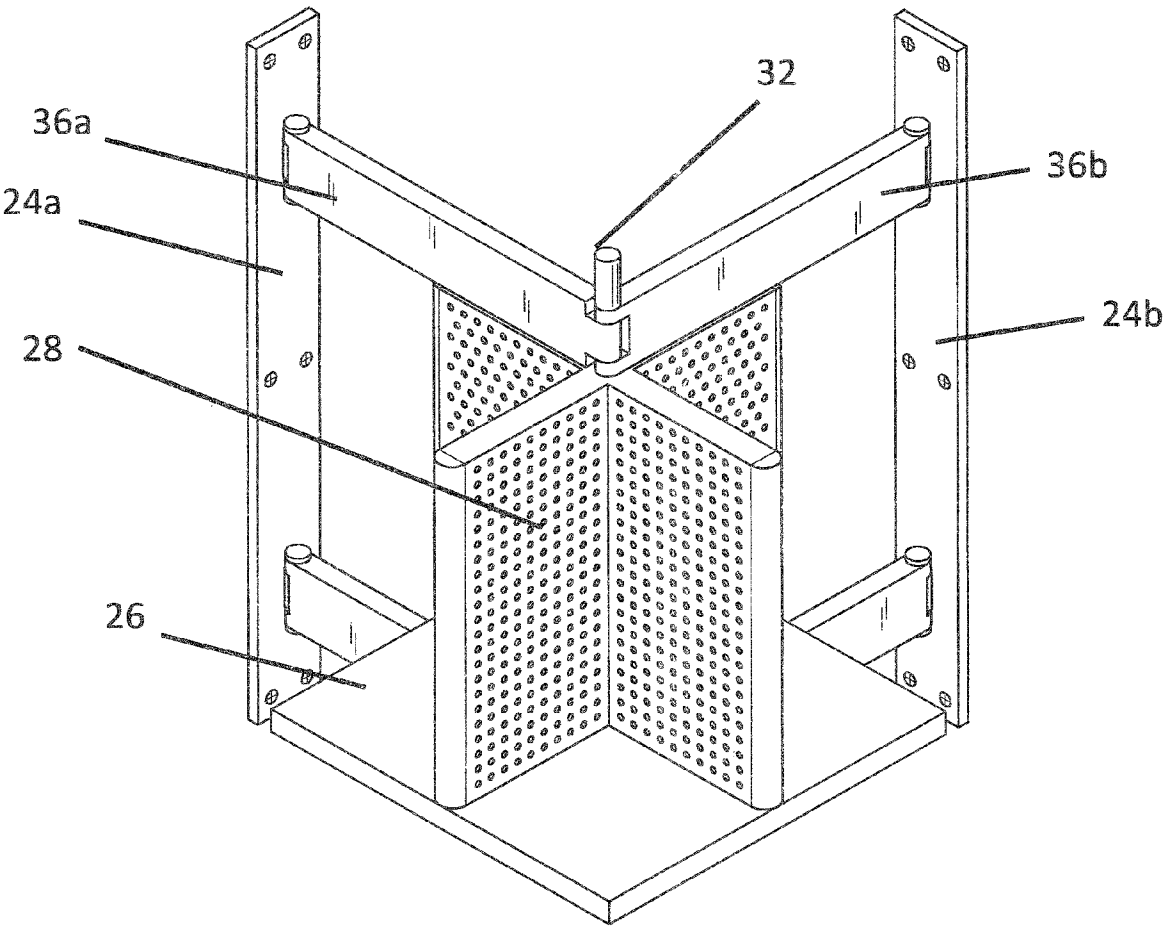
FIG. 13 is a perspective view of an alternative embodiment of the apparatus of the present invention, wherein the storage panels are constructed as a single piece.
Figure 14:
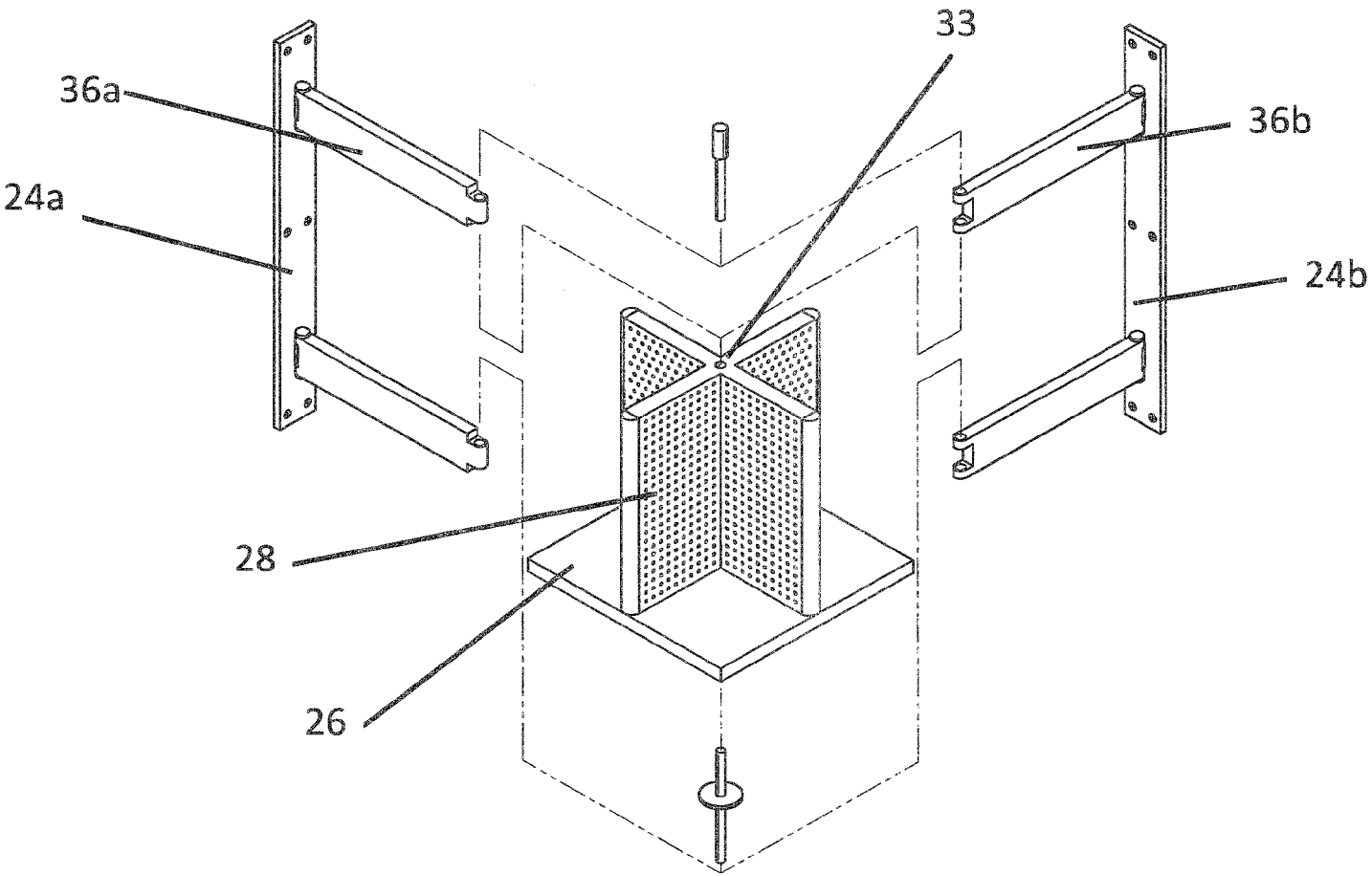
FIG. 14 is an exploded view of the apparatus of FIG. 13.
Figure 15:
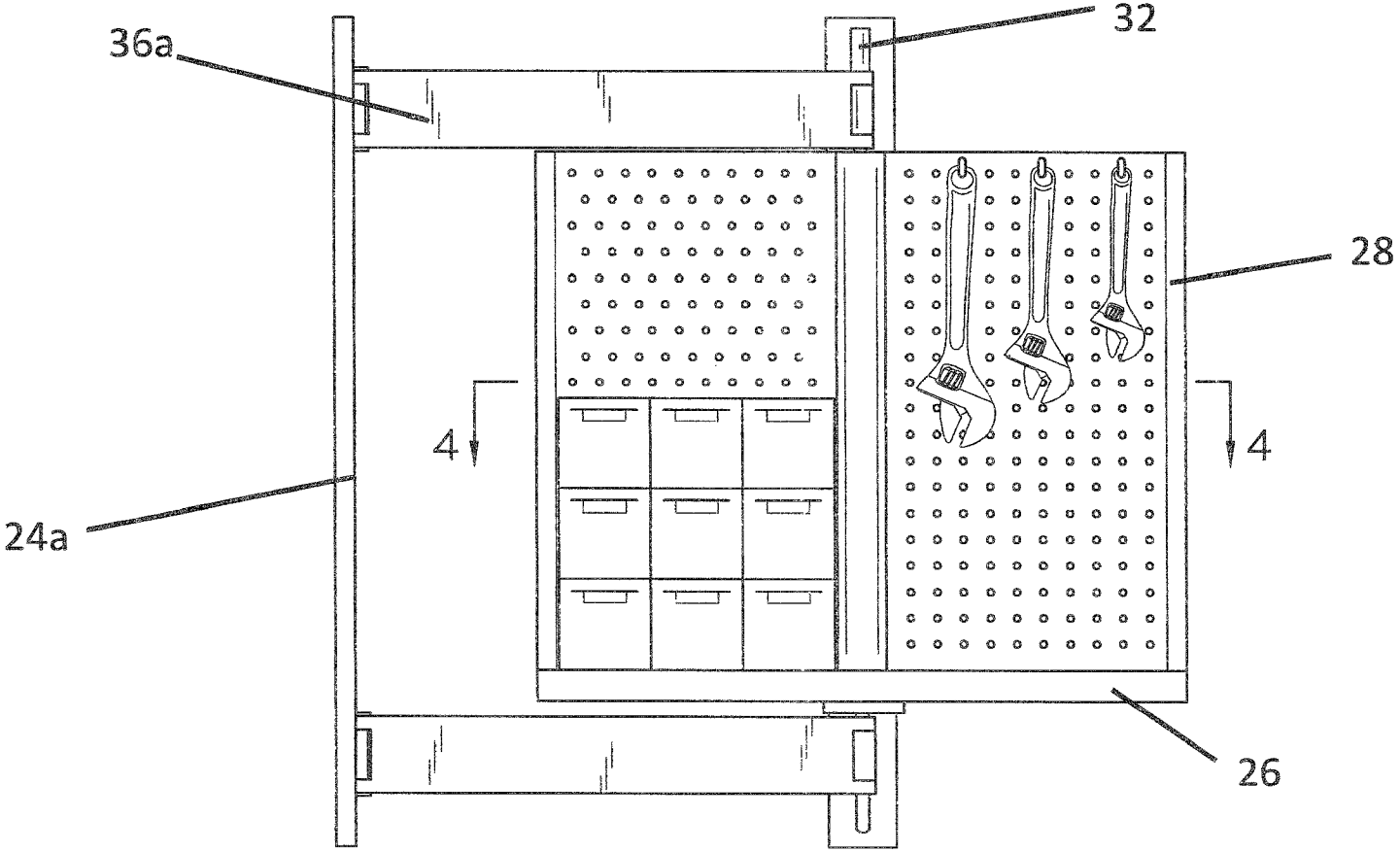
FIG. 15 is a side view of the apparatus of FIG. 13.
Figure 16:
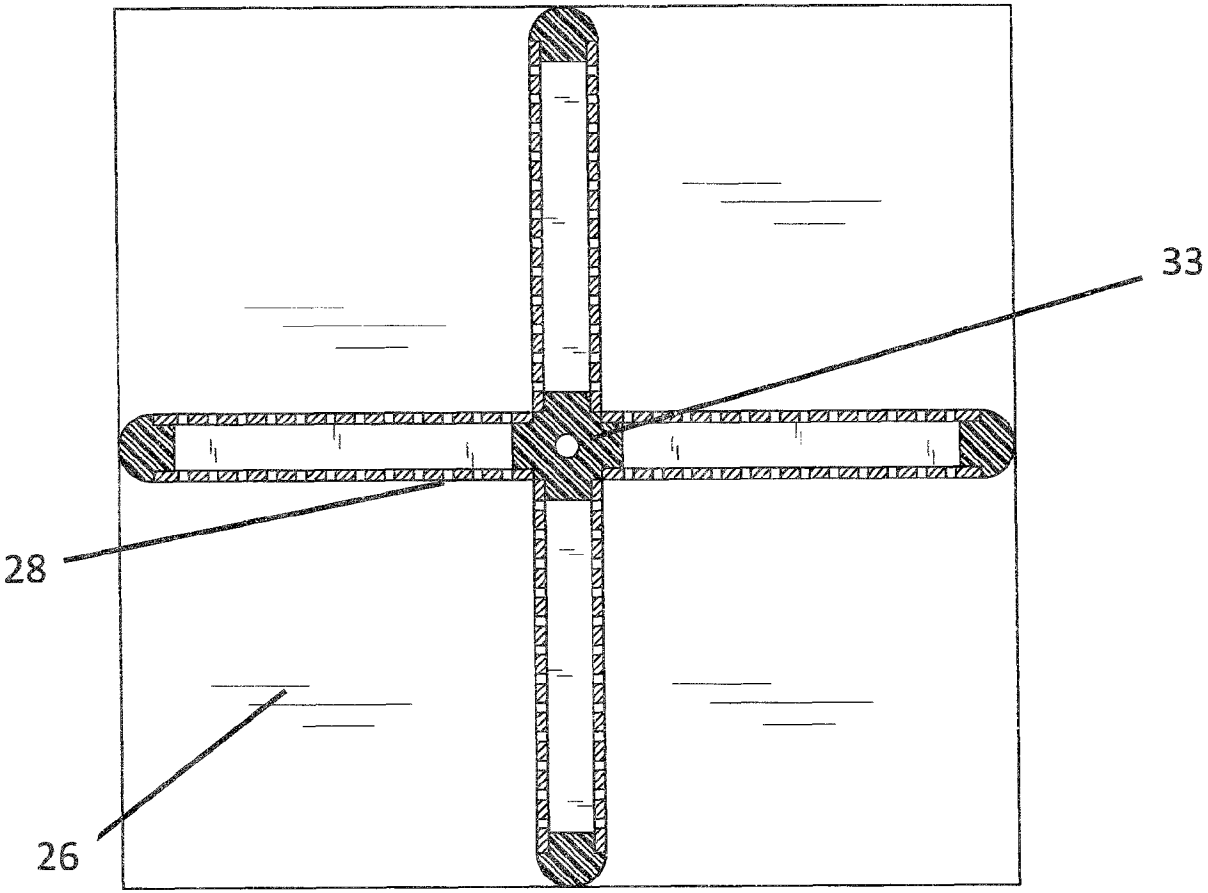
FIG. 16 is a top cross sectional view of the apparatus of FIG. 15.
Figure 17:
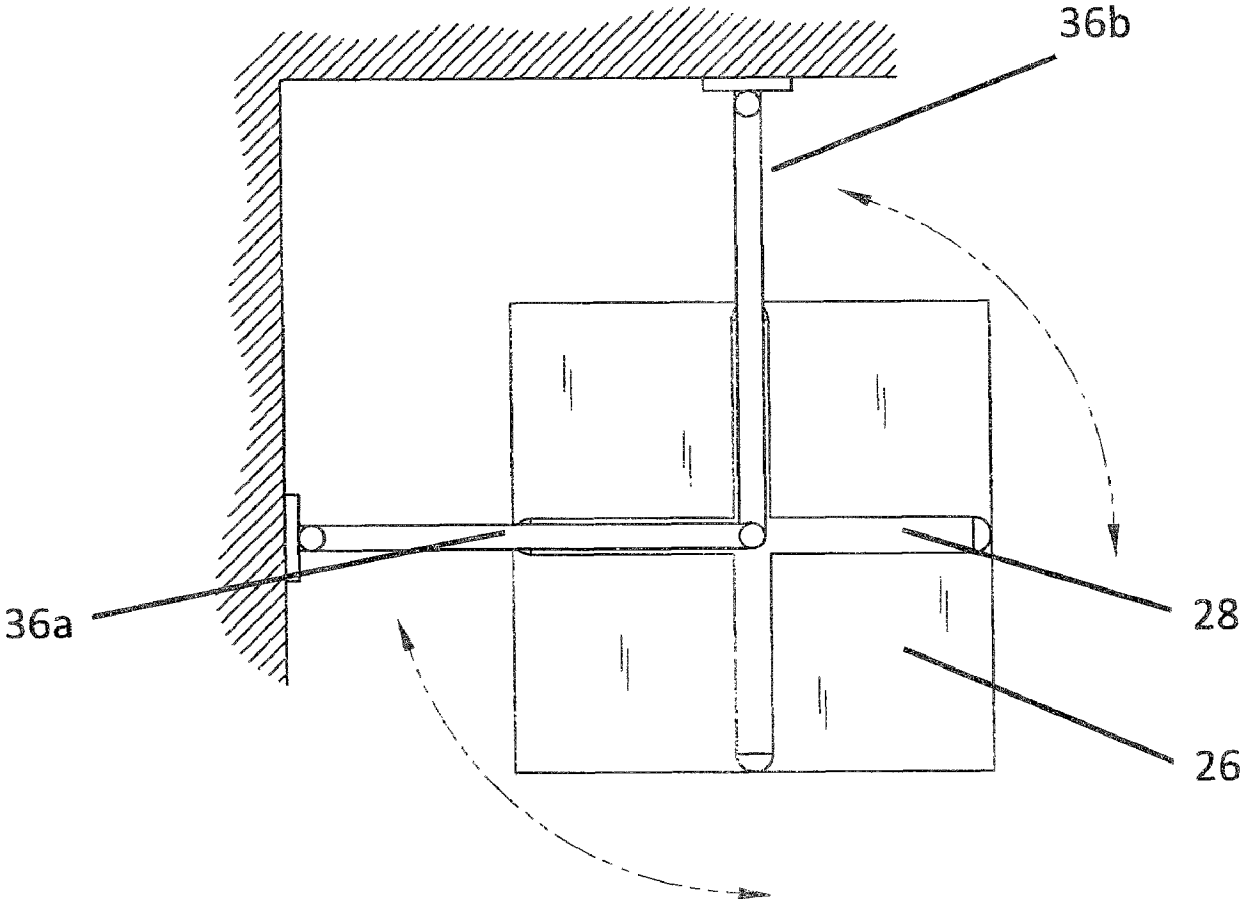
FIG. 17 is a top view of the apparatus of FIG. 13 wherein the apparatus is mounted in a corner.
Figure 18:
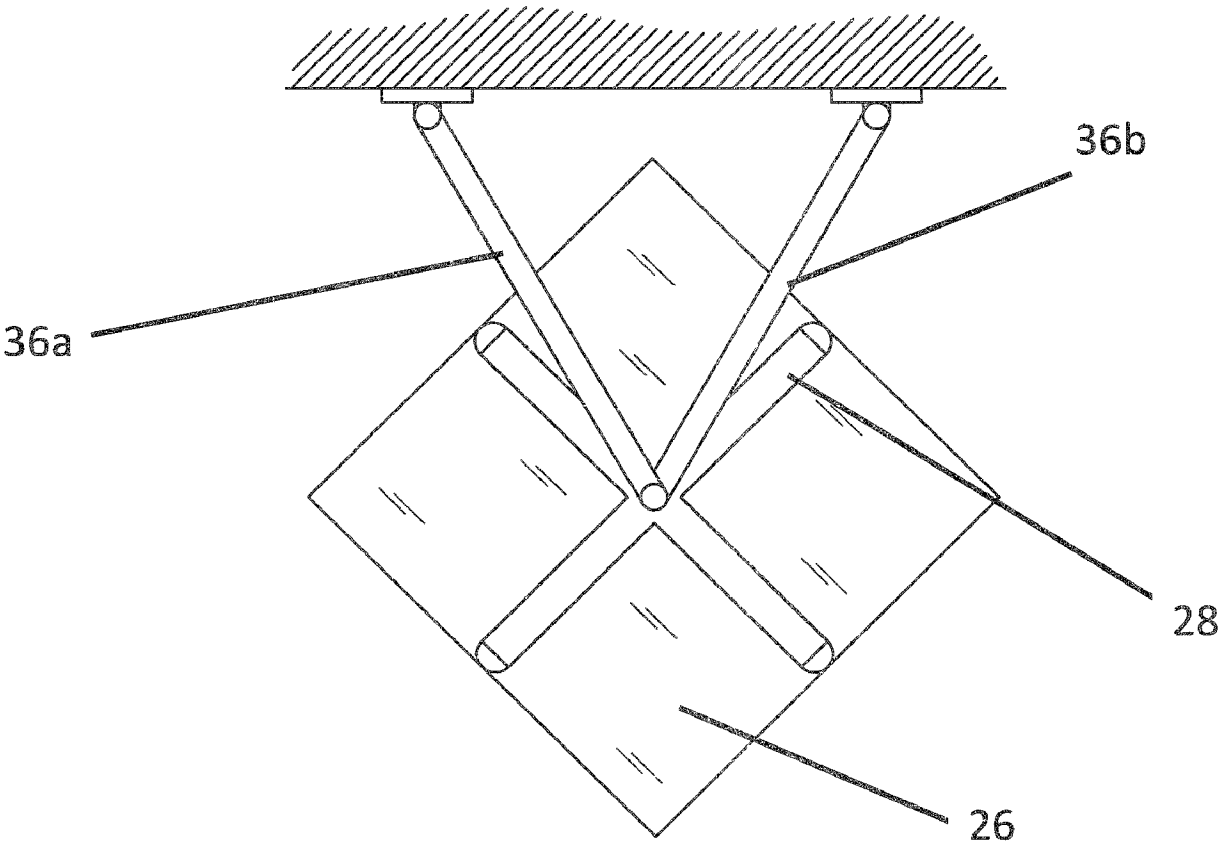
FIG. 18 is a top view top view of the apparatus of FIG. 13 wherein the apparatus is mounted to a single wall.

In some embodiments, the first end of the axle 32 extends through the base 26 (see FIG. 12). The second ends of the base arms 37*a*, 37*b* may engage the first end of the axle 32. In some embodiments, a fourth hinge is disposed on the second ends of the base arms 37, wherein the hinge pin of the fourth hinge is the axle 32 (e.g., the first end of the axle 32). In other words, the base arms 37 of the mounting brackets 24*a*, 24*b* may cooperate to form the fourth hinge and to retain the axle 32.

The distance between the arm 36*a* and the base arm 37*a* on the first mounting bracket 24*a* (or the distance between the arm 36*b* and the base arm 37*b* on the second mounting bracket 24*b*) generally corresponds to the height of the tool carousel 22 (or roughly the height of the carousel 22), however the present invention is not limited to this distance. In some embodiments, the length of the arms 36 and/or base arms 37 (e.g., as measured from the first end to the second end) is determined by the radius of the tool carousel. In some embodiments, the length is sufficient to allow the loaded carousel to rotate freely without interference from the arms 36, 37 or mounting brackets 24.

Figure 11:
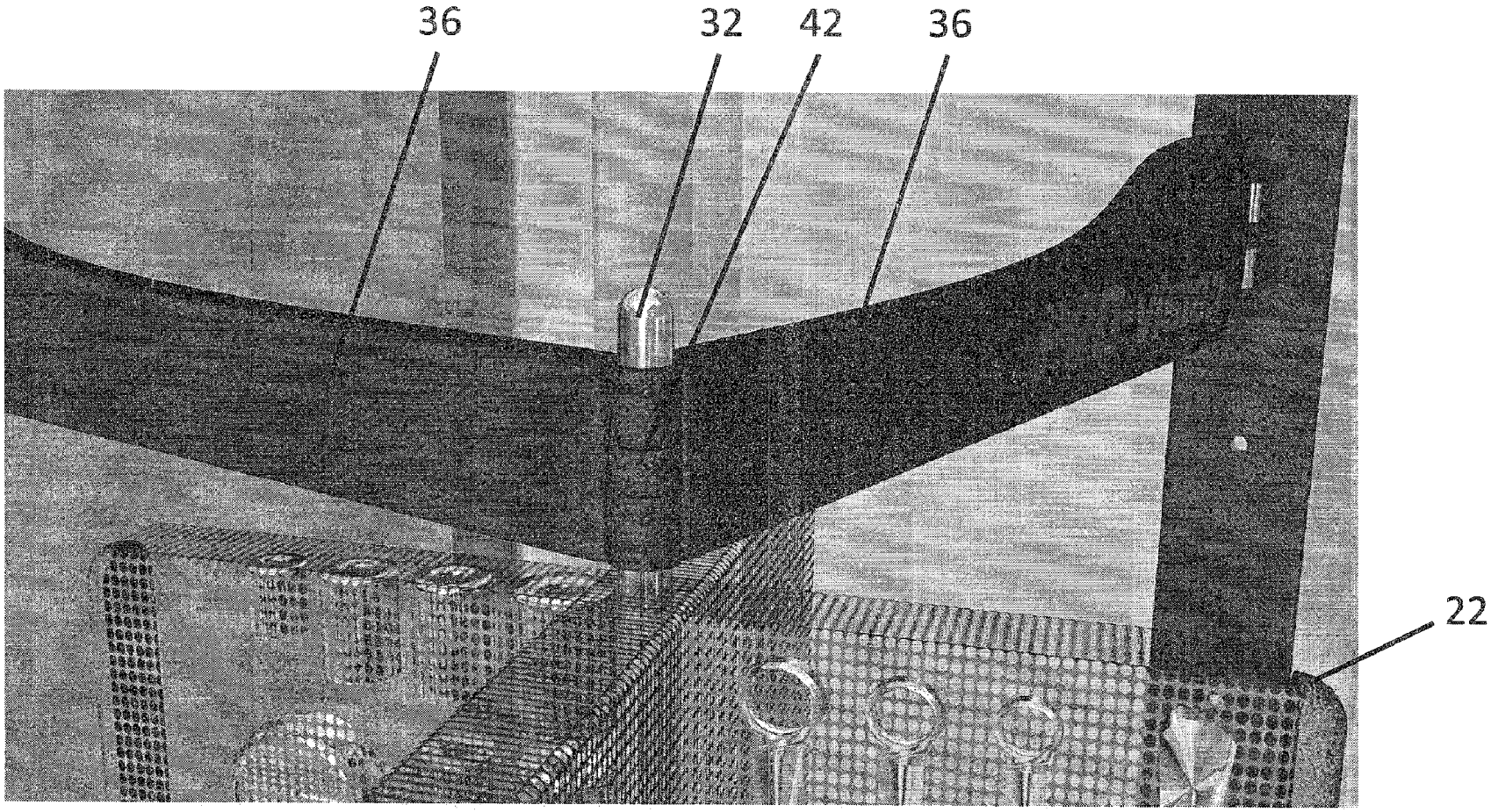
FIG. 11 is a detailed view of the arms of the apparatus.

Referring to FIG. 11, the arms 36 are cooperate to form the second hinge 42 with the axle 32. The axle 32 functions as the hinge pin and may or may not rotate with the storage panels. Referring to FIG. 12, the base arms 37 support the weight of the tool carousel 22. The axle 32 is received through the butt hinge (e.g., fourth hinge) cooperatively formed by the base arms 37. A spacer component, for example a washer 52, a ball-bearing, or the like, is positioned between the upper surface of the arms and the base 26 of the tool carousel 22 (the bottom surface of the base 26) to space the base from the arms, permit the tool carousel 22 to be rotated, and prevent rocking. The spacer is not limited to the aforementioned examples and may include any component that functions to space the base from the arms and permit the tool carousel 22 to be rotated.

The present invention is not limited to the aforementioned examples of assembly and construction of storage panels 28. For example, FIGS. 13-18 show an apparatus 20 of the present invention comprising a tool carousel 22 with a storage panel 28 constructed as a solid piece. The axle 32 extends through the center region of the single piece storage panel 28. In some embodiments, a shaft 33 is provided through the center region of the panel 28 to allow the axle 32 to be received (see FIG. 14, FIG. 16).

Figure 19:
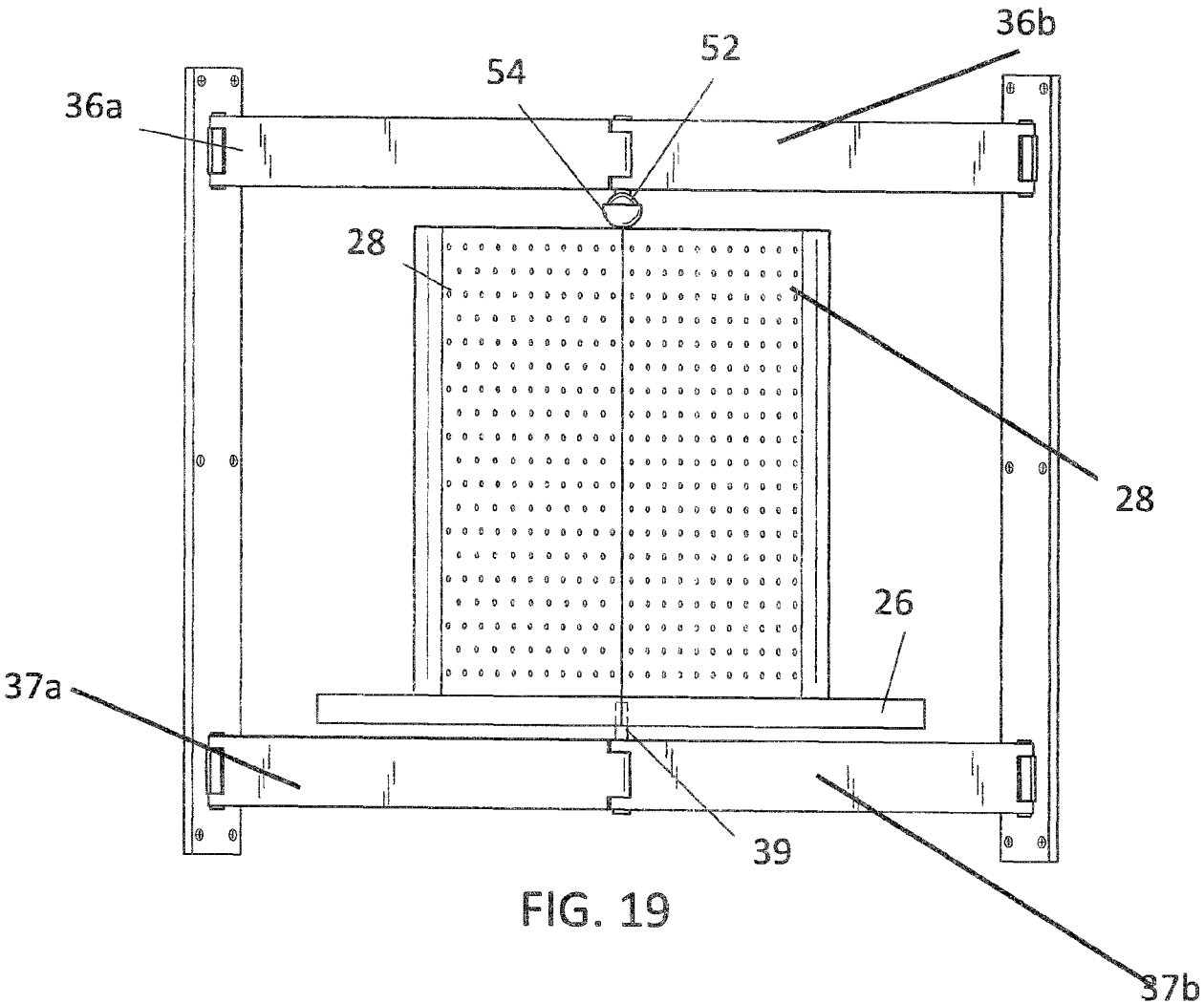
FIG. 19 is a front view of an alternative embodiment of the apparatus of the present invention.

The present invention is not limited to rotating system (which allows the tool carousel 22 to rotate) comprising a central axle 32. For example, the rotating system may be a ball bearing system combined with a pivot pin 39. FIG. 19 shows an apparatus 20 of the present invention wherein the second ends of the arms 36 engage a ball bearing system, which engages the storage panel 28. Ball bearing systems are well known to one of ordinary skill in the art. For example, as shown in FIG. 19, a bowl component 52 is disposed on the top edge of the storage panel 28 (e.g., at the center region). A ball 54 snugly and rotatably fits into the bowl component 52. The tool carousel 22 may rotate about a pivot pin 39, which like the axle 32, can engage the second ends of the base arms 37*a*, 37*b*. The pivot pin 39 may engage the base arms 37 and extend through the base 26 to the storage panel 28.

In some embodiments, the apparatus 20 of FIG. 19 allows for a snap-in means of quick release (or quick assembly). For example, the pivot pin 39 may be prefabricated into the base arm(s) 37 and the bail 54 is prefabricated into the top arm(s) 36. The bowl component 52 may be prefabricated on the storage panel 28. The ball 54 can snap in and out of the bowl component 52.

As used herein, the term "about" refers to plus or minus 10% of the referenced number. For example, an embodiment wherein the angle between the arms 36 is about 90 degrees includes an angle between 81 and 99 degrees.

The following the disclosures of the following U.S. patents are incorporated in their entirety by reference herein: U.S. Pat. No. 3,379,484; U.S. Pat. No. 2,868,386; U.S. Pat. No. 5,139,155; U.S. Pat. No. 3,514,883; U.S. Pat. No. 3,391,796; U.S. Pat. No. 6,272,779.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tool storage and organization apparatus comprising:

(a) a rotating tool carousel comprising a base to which a first storage panel and a second storage panel are attached, the storage panels function to store and organize tools and hardware;

(b) a rotating system extending downwardly through the base and upwardly past top edges of the storage panels, wherein the tool carousel is permitted to rotate freely in a first direction or second direction either (i) with respect to the rotating system or (ii) along with the rotating system;

(c) a first mounting bracket and a second mounting bracket, the mounting brackets are each adapted to be mounted to a supporting structure, the mounting brackets each have a first end and a second end;

(d) a first base arm pivotally attached to the first mounting bracket near the first end and a second base arm pivotally attached to the second mounting bracket near the first end, the base arms each extend laterally from the respective mounting bracket, wherein a second end of the first base arm and a second end of the second base arm cooperate to engage the rotating system;

(e) a first top arm pivotally attached to the first mounting bracket near the second end, and a second top arm pivotally attached to the second mounting bracket near the second end, the top arms each extend laterally from the respective mounting bracket, wherein a second end of the first top arm and a second end of the second top arm cooperate to engage the rotating system; and (f) a spacer component positioned between an upper surface of the base arms and the base of the tool carousel to space the base of the tool carousel from the base arms and to permit the tool carousel to be rotated.

2. The apparatus of claim 1, wherein the storage panels are constructed as a single piece.

3. The apparatus of claim 1, wherein the storage panels are constructed from a material comprising a pegboard, slat board, or a grid that defines a plurality of openings.

4. The apparatus of claim 1, wherein the storage panels interconnect to form a structure having a generally plus sign-shaped cross section.

5. The apparatus of claim 1, wherein the tool carousel further comprises one or more storage cabinets.

6. The apparatus of claim 5, wherein the cabinets comprise drawers.

7. The apparatus of claim 1, wherein the storage panels each comprise an end cover.

8. The apparatus of claim 1, wherein the first storage panel comprises a first slot for receiving a second slot disposed in the second storage panel.

9. The apparatus of claim 1, wherein the rotating system comprises a central axle extending through an intersection of the first storage panel and the second storage panel, the axle has a first end that extends downwardly through the base and a second end that extends upwardly past top edges of the storage panels, wherein the tool carousel is permitted to rotate freely in a first direction or second direction either (i) with respect to the axle or (ii) along with the axle.

10. The apparatus of claim 9, wherein the second end of the first base arm and the second end of the second base arm cooperate to engage the first end of the axle.

11. The apparatus of claim 9, wherein the second end of the first top arm and the second end of the second top arm cooperate to engage the second end of the axle.

12. The apparatus of claim 9, wherein a shaft is provided through the first storage panel and the second storage panel to allow the axle to be received.

13. The apparatus of claim 1, wherein the rotating system comprises a ball bearing system, wherein the second end of the first top arm and the second end of the second top arm cooperate to engage the ball bearing system, wherein the second end of the first base arm and the second end of the second base arm cooperate to engage pivot pin that extends through the base to the storage panel, wherein the tool carousel is permitted to rotate freely in a first direction or second direction either (i) with respect to the ball bearing system and pivot pin or (ii) along with the ball bearing system and pivot pin.

14. The apparatus of claim 13, wherein the ball bearing system comprises a bowl component disposed on a top edge of the storage panel, and a ball that engages the second end of the first top arm and the second end of the second top arm, the ball snugly and rotatably fits into the bowl component.

15. The apparatus of claim 1, wherein the mounting brackets each comprise a plurality of holes for receiving screws, bolts or nails.

16. The apparatus of claim 1, wherein the first top arm is pivotally attached to the first mounting bracket or the second top arm is pivotally attached to the second mounting bracket via a first hinge.

17. The apparatus of claim 16, wherein the first hinge is a three-loop butt-type hinge.

18. The apparatus of claim 1, wherein the first base arm is pivotally attached to the first mounting bracket or the second base arm is pivotally attached to the second mounting bracket via a third hinge.

19. The apparatus of claim 18, wherein the third hinge is a three-loop butt-type hinge.

20. The apparatus of claim 1, wherein the apparatus further comprises a level to facilitate level mounting.

* * * * *